United States Patent [19]

Ruehl et al.

[11] Patent Number: 4,588,240

[45] Date of Patent: May 13, 1986

[54] BRIDGING CLIP

[76] Inventors: William E. Ruehl, 316 Surrey Rd., Wheeling, Ill. 60090; Edwin G. Swick, 28W629 Stearns Rd., Bartlett, Ill. 60103

[21] Appl. No.: 755,965

[22] Filed: Jul. 17, 1985

Related U.S. Application Data

[63] Continuation of Ser. No. 552,551, Nov. 16, 1983, abandoned.

[51] Int. Cl.[4] ..... H01R 31/08

[52] U.S. Cl. ..... 339/19; 339/258 R

[58] Field of Search ..... 339/19, 258 R

[56] References Cited

U.S. PATENT DOCUMENTS

D. 224,406 7/1972 Heck ..... 339/19

2,967,288 1/1961 Keller ..... 339/258 R 3,192,498 6/1965 Ruehlemann ..... 339/258 R

FOREIGN PATENT DOCUMENTS 2234725 1/1974 Fed. Rep. of Germany ... 339/258 R

*Primary Examiner*—Neil Abrams

[57] ABSTRACT

A bridging clip is provided for telephone circuits and the like comprising a pair of sheet metal legs initially converging, and diverging at the extremities to facilitate application of the bridging clip. Pairs of ribs which are relatively crossed are provided on the inner confronting surfaces of the legs at the areas of inflection between the converging and diverging portions of the legs, thereby increasing contact pressure and minimizing contact resistance.

5 Claims, 4 Drawing Figures

FIG. 1
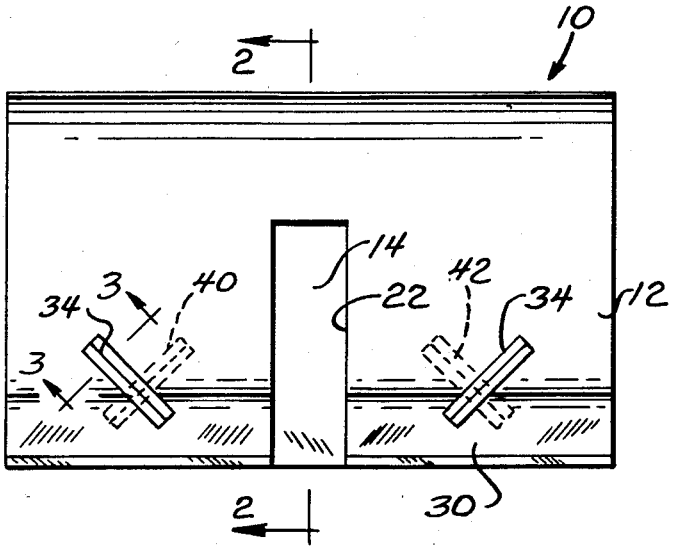
FIG. 2
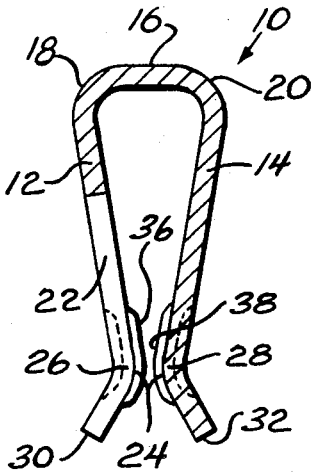
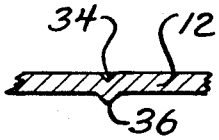
FIG. 3
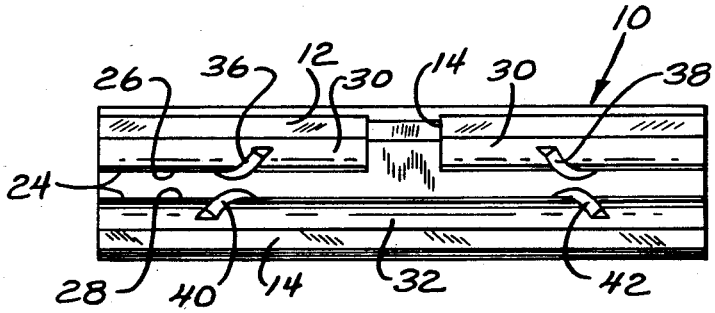
FIG. 4

BRIDGING CLIP

This application is a continuation of application Ser. No. 552,551, filed Nov. 16, 1983, now abandoned.

BACKGROUND OF THE INVENTION

Bridging clips have been used for some years in central office and subscriber telephone lines on 66-type connector blocks without hard wiring. Such connector blocks are shown, for example, in U.S. Pat. Nos. 4,053,705, 4,113,340 and 4,126,369. For several years the assignee of the present application, Illinois Tool Works, Inc. of Chicago, Ill. has manufactured bridging clips as shown in U.S. Pat. Nos. Des. 224,405 and 224,406. Audio frequencies representing human speech are carried by such bridging clips in telephone circuits, and noise can be introduced which is annoying and can render the speech difficult to understand if a proper contact is not made. The telephone companies over the years have progressively tightened specifications as to contact resistance on bridging clips, and at the present time a specification of 10 milliohms maximum is in force.

Early bridging clips constructed in accordance with the aforesaid U.S. Pat. Nos. Des. 224,405 and 224,406 generally ran on the order of 10 to 20 milliohms contact resistance. The material in such clips was changed from stainless steel to solder plated phosphor bronze in order to meet temporary specifications. However, this greatly increased the cost of the bridging clips.

OBJECTS AND SUMMARY OF THE PRESENT INVENTION

Accordingly, it is an object of this invention to provide an improved bridging clip having a reduced contact resistance.

More particularly, it is an object of the present invention to provide a bridging clip having angularly disposed ribs on the contacting surfaces producing a significantly reduced contact resistance.

A bridging clip in accordance with the present invention comprises a generally U-shaped structure of sheet material including, in cross-section, a pair of converging legs and an interconnecting bight. The extremities of the legs are divergingly deflected to facilitate placing of the bridging clip over the connector block terminals that are to be bridged. Substantially midway from end to end of the bridging clip one leg thereof is provided with a slot, thereby providing individual resiliency for the portions of the bridging clip engaging different terminals of a connector block.

Contact of the bridging clip with the terminals is primarily with the most closely confronting surfaces of the legs, and to some degree inwardly thereof. In accordance with the present invention these surfaces are provided with diagonal ribs, the ribs of confronting surfaces being at right angles to one another. This affords a higher pressure at the area of contact and allows the use of stainless steel for manufacturing the bridging clips, thereby permitting the clips to be manufactured and sold at lower cost while meeting current contact resistance specifications.

THE DRAWINGS

The present invention will best be understood from the following specification when taken in connection with the accompanying drawings wherein:

FIG. 1 is a side view on an enlarged scale showing a bridging clip constructed in accordance with the principles of the present invention;

FIG. 2 is a cross-sectional view through the bridging clip taken substantially along the line 2—2 in FIG. 1;

FIG. 3 is a fragmentary cross-sectional view taken substantially along the line 3—3 in FIG. 1; and FIG. 4 is a bottom view of the bridging clip.

DETAILED DISCLOSURE OF THE ILLUSTRATIVE EMBODIMENT

Turning now in greater particularity to the drawings there will be seen an improved bridging clip 10 constructed in accordance with the present invention. The bridging clip is constructed of sheet metal, specifically stainless steel, and comprises an elongated body defined by a pair of converging legs 12 and 14 interconnected by a straight bight 16 joined to the legs by curved sections 18 and 20. The leg 12 is provided with a central vertical slot 22 permitting independent movement of the portions to the left and right thereof as viewed in FIG. 1.

The legs have a position of closest approach 24 and inflections 26 and 28 in the legs where diverging entering end portions 30 and 32 of the legs are provided.

The improvement in the present invention resides in the provision of pairs of indentations 34 spaced on opposite sides of the slot 22 in the leg 12 and confronting indentations in the leg 14 to provide ribs 36 and 38 on the inner face of the leg 12 and ribs 40 and 42 on the inner face of the leg 14. It is to be noted that the indentations and ribs are oriented at 45 degrees, that the confronting ribs on the opposite legs are oriented at right angles to one another, and that the ribs on the leg 12 diverge from the outer edge (the bottom as viewed in FIG. 1) upwards, while the indentations and ribs on the leg 14 converge in the same direction. The indentations and ribs are formed in the sheet metal from which the improved bridging clip is made before the sheet metal is folded into the shape heretofore described. The ribs are oriented across the inflections 26 and 28 whereby the ribs are curved from end to end as well as being substantially V-shaped in cross-section. Contact with the connector block terminals is on the ribs, generally at the inflections 26 and 28, and somewhat inwardly (upwardly in FIGS. 1 and 2) therefrom, whereby contact is over a rather short, sharp line, or more or less at a point at the inflections. Accordingly, pressure at the contact areas is substantially higher than would be the case in the absence of the ribs.

The specific example of the invention as herein shown and described will be understood as being exemplary only. Various changes in structure will no doubt occur to those skilled in the art and will be understood as forming a part of the present invention insofar as they fall within the spirit and scope of the appended claims.

The invention is claimed as follows:

1. A bridging clip comprising an integral formed sheet metal member comprising a bight and a pair of legs converging from said bight to confronting inflection areas and thereafter diverging, the intersection of the converging portion of each leg with the diverging portion defining a bend line generally parallel with said bight, an integral elongate continuously curved rib formed on each of said legs with a V-shape cross section and extending transversely across said confronting inflection areas, said ribs having a criss-cross ninety degree orientation with respect to each other and having a point of intersection in said confronting inflection areas, said confronting area of said legs being spaced apart in the unflexed condition to provide an open space between said ribs, the angle between said ribs and said bend line on each leg being forty-five degrees.

2. A bridging clip as set forth in claim 1, wherein said ribs are disposed perpendicular with respect to each other.

3. A bridging clip as set forth in claim 2, wherein each of said ribs is formed by an indentation on the inner face of said legs.

4. A bridging clip comprising an integral formed U-shaped sheet metal member having a longitudinal axis and having a bight and a pair of legs converging from said bight to confronting inflection areas and thereafter diverging, one of said pair of legs being bifurcated outwardly from said bight to define a pair of leg portions, an integral elongate continously curved rib formed on each of said leg portions with a V-shape cross section which extend transversely across said confronting inflection area in a centered relation with respect to the width of said leg portion, and which are disposed perpendicular with respect to each other, the intersection of the converging portion of each leg with the diverging portion defining a bend line generally parallel with said bight, and an integral elongate rib formed on the other of said pair of legs in general register with said ribs on said leg portion, said ribs on said one pair of legs having a perpendicular orientation with respect to the confronting ribs on said other pair of legs and having a point of intersection in said confronting inflection areas, each of said leg portions being spaced from said other of said pair of legs at said confronting inflection areas in the unflexed condition to provide an open space between the respective pair of ribs, said ribs crossing said bend line on each leg at a forty-five degree orientation.

5. A bridging clip as set forth in claim 4, wherein each of said ribs is formed by an indentation on the inner face of said legs.

* * * * *